US005379833A

United States Patent [19]

Mathews

[11] Patent Number: 5,379,833

[45] Date of Patent: Jan. 10, 1995

[54] HEAT EXCHANGER WITH INTEGRAL SUBCOOLER

[75] Inventor: Douglas H. Mathews, Three Rivers, Mich.

[73] Assignee: Koolant Koolers, Inc., Jackson, Mich.

[21] Appl. No.: 162,950

[22] Filed: Dec. 8, 1993

[51] Int. Cl.[6] ..... F25B 1/06; F28B 40/02

[52] U.S. Cl. ..... 165/113; 165/144; 165/132; 165/176; 62/509

[58] Field of Search ..... 165/110, 150, 144, 132, 165/113, 176; 62/509

[56] References Cited

U.S. PATENT DOCUMENTS

| | | | |
|---|---|---|---|
| 2,286,025 | 6/1942 | Thomas | 62/125 |
| 4,172,496 | 10/1979 | Melnyk | 165/150 |
| 4,770,240 | 9/1988 | Dawson et al. | 165/176 |
| 4,972,683 | 11/1990 | Beatenbough | 62/509 |
| 5,146,767 | 9/1992 | Kadle et al. | 62/474 |
| 5,159,821 | 11/1992 | Nakamura | 62/509 |
| 5,201,190 | 4/1993 | Nelson et al. | 62/210 |

*Primary Examiner*—Albert W. Davis, Jr.
*Attorney, Agent, or Firm*—Beaman & Beaman

[57] ABSTRACT

A heat exchanger for a refrigeration circuit for condensing gaseous refrigerant and incorporating an integral refrigerant subcooler. The heat exchanger utilizes an oversized header communicating with the heat exchanger coils of sufficient volume to serve as a reservoir for condensed refrigerant eliminating the need for a separate receiver receptacle. Refrigerant subcooling occurs at the lower region of the receiver whereby the subcooler is automatically provided with liquified refrigerant from the condensing portion of the heat exchanger.

3 Claims, 1 Drawing Sheet

HEAT EXCHANGER WITH INTEGRAL SUBCOOLER

BACKGROUND OF THE INVENTION

1. Field of the Invention

The invention pertains to heat exchangers for refrigeration circuits which condense refrigerant.

2. Description of the Related Art

Refrigeration circuits include a condensing coil usually consisting of conduits or tubes mechanically connected to metal fins whereby the tubes are cooled by air being forced over the fins and tubes, and such cooling of the tubes and heat exchanger condense gaseous refrigerant to a liquid state prior to the liquid being expanded for heat absorption purposes.

Conventional condensing heat exchangers include a header or manifold supplying the gaseous refrigerant to the coils, and the liquified refrigerant from the heat exchanger is piped to a separate external receiver reservoir prior to the liquified refrigerant being expanded.

As the receiver constitutes a separate component in the refrigeration circuit, its manufacture and associated plumbing and conduits add to the expense of the circuit.

The liquified refrigerant stored within the receiver may "flash back" to a gas before reaching the expansion device, depending on the temperature and pressure of the refrigerant with respect to its saturation point, and to prevent such "flash back" it is known to subcool the liquid refrigerant by a separate subcooling heat exchanger. Subcooling is well known in the refrigeration art as shown in U.S. Pat. Nos. 2,286,025 and 5,146,767.

The requirement to provide a separate subcooling heat exchanger, in combination with a separate refrigerant receiver, all adds to the expense of manufacturing the refrigeration circuit components, and further increases the bulk and size of the space necessary to accommodate the refrigeration circuit components.

OBJECTS OF THE INVENTION

It is an object of the invention to provide a heat exchanger for a refrigeration circuit capable of cooling and condensing the refrigerant, and also capable of subcooling the condensed refrigerant, all within a concise configuration, and at minimal expense.

Another object of the invention is to provide a heat exchanger for refrigeration circuits incorporating a condensed refrigerant subcooler and wherein the header for the heat exchanger is so located to the heat exchanger, and of sufficient volume, as to constitute a condensed refrigerant receiver eliminating the necessity for a separate receiver receptacle.

Yet a further object of the invention is to reduce the size and cost of refrigeration circuit components by integrating the heat exchanging apparatus for condensing the refrigerant with a subcooler for subcooling the condensed refrigerant and with a receiver for storing the condensed refrigerant during subcooling and prior to supplying the condensed refrigerant to the expansion valve and chamber.

SUMMARY OF THE INVENTION

In the practice of the invention, a finned, air cooled heat exchanger utilizes two separate sets of coils while sharing heat exchanging fins and an overall integral configuration.

The heat exchanger apparatus is oriented to the vertical, including slanted to the vertical, such that condensing of the gaseous refrigerant occurs in the upper regions of the heat exchanger, while subcooling of the condensed refrigerant occurs in the heat exchanger lower region. The condensing coils are supplied through a manifold disposed adjacent the upper region of an elongated receiver located adjacent the heat exchanger coils, and a second manifold disposed adjacent the receiver lower region is in communication with the lower set of coils for establishing communication with super cooled refrigerant and the refrigeration circuit expansion device.

The receiver located adjacent the heat exchanger is of relatively large volume with respect to the volume of the heat exchanger as defined by the gas and liquid refrigerant conducting conduits and tubes, the receiver volume being at least 15% greater than that of the other directly associated heat exchanger components. As the gaseous refrigerant is condensed to a liquid in the upper set of coils, the liquid refrigerant collects in the lower regions of the receiver and is supplied to the lower set of coils for subcooling of the refrigerant. The subcooled refrigerant communicates with a manifold which supplies the circuit expansion device.

By integrating the refrigerant subcooling circuit into the condensing heat exchanger, and utilizing a receiver of sufficient volume and location to serve as both a header for the condensing heat exchanger and a reservoir for the liquified refrigerant, the cost of providing the necessary components for a refrigeration circuit is reduced, and a more concise configuration of such components is attained.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENT

Figure 1:
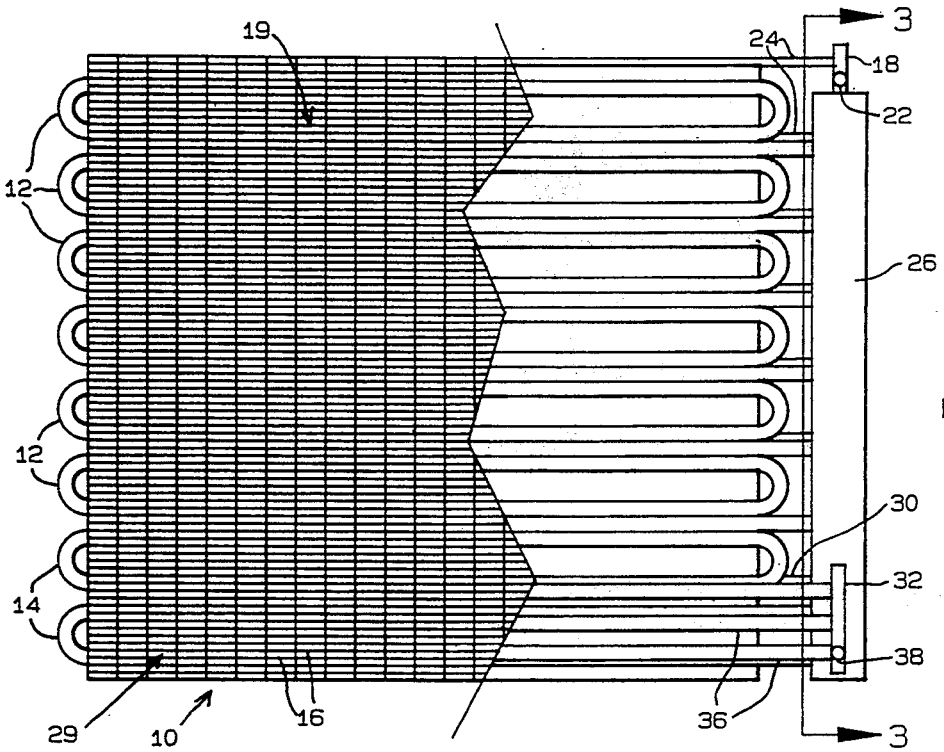
FIG. 1 is an elevational view, partially sectioned, illustrating a heat exchanger in accord with the invention.

A heat exchanger in accord with the invention is generally indicated at 10 and includes a plurality of upper coils 12, and a plurality of lower coils 14, two of which are shown in the illustrated embodiment. A plurality of parallel metal heat conducting fins 16 are mechanically attached to the coils 12 and 14 whereby air passing through the heat exchanger 16 cools the fins and coils, and the refrigerant contained in the coils. The particular construction of the coils 12 and 14, and the fins 16, constitutes no part of the instant invention, and a variety of coil and fin constructions may be used as is well known in the heat exchanger art.

An elongated vertically oriented inlet manifold 18 is located adjacent the upper region 19 of the heat exchanger 10 in which the coils 12 are located. The inlet manifold 18 is mounted upon the receiver, later described, by supports 20, and the inlet manifold basically constitutes a cylindrical conduit. At its upper end, the inlet manifold 18 includes an inlet tube 22 into which the pressurized gaseous refrigerant is introduced by a conduit, not shown, and, hence, into the heat exchanger coils 12 to permit condensation of the gaseous refrigerant to a liquid form.

The coils 12 formed in the heat exchanger upper region 19 each include an inlet 24 in communication with the inlet manifold 18, and the pressurized gaseous refrigerant introduced into the manifold 18 through inlet tube 22 will thereby be simultaneously supplied to the coils 12.

Figure 2:
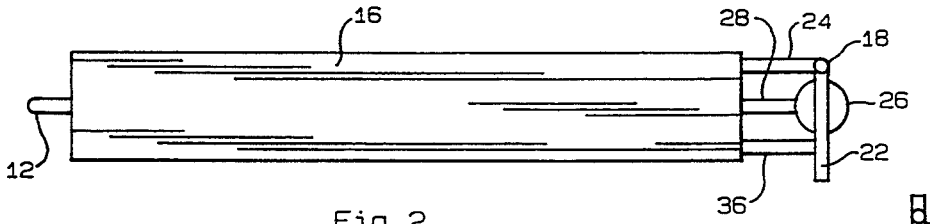
FIG. 2 is a top plan view of the heat exchanger of FIG. 1.
Figure 4:
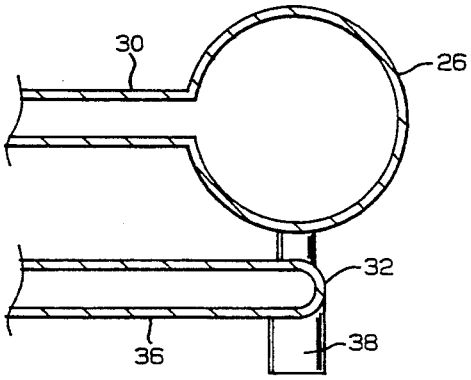
FIG. 4 is a detail plan sectional view taken through the lower region of the receiver and lower manifold as taken along Section 4—4 of FIG. 3.

An elongated tubular receiver 26 is defined adjacent the right end of the heat exchanger 10 as illustrated in FIGS. 1 and 2. The receiver 26 may be of a cylindrical configuration and is vertically oriented during normal operation and is of a height substantially equal to the height of the heat exchanger 10. A plurality of inlets 28 are defined upon the receiver 26 as will be appreciated from FIG. 3, and the inlets 28 constitute the outlets of the coils 12. Therefore, the gaseous refrigerant introduced into the coils 12 at inlets 24 will condense within the coils 12 and in a liquified form the refrigerant will flow into the receiver 26 through the coil outlets 28.

Figure 3:
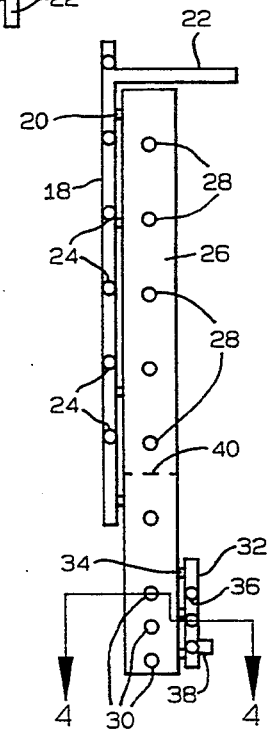
FIG. 3 is an elevational sectional view as taken along Section 3—3 of FIG. 1.

The coils 14 located in the heat exchanger lower region 29 include inlets 30, FIG. 3, in communication with the lower region of the receiver 26. In this manner, the coils 14, which constitute the subcooling coils, will be supplied with liquified refrigerant from the receiver 26.

A tubular manifold 32 is attached to the lower region of the receiver 26 by supports 34, and the manifold 32 includes a plurality of coil outlets 36 constituting the outlets of the coils 14. Accordingly, the liquid refrigerant introduced into the coils 14 at inlets 30, after subcooling, will flow into the manifold 32 through the outlets 36.

An outlet tube 38 communicates with the interior of manifold 32, and the outlet tube 38 will attach to conduit, not shown, communicating with the refrigerant circuit expansion device or valve.

As will be appreciated from FIG. 3, the inlets 30 and the outlets 36 of the coils 14 are at, approximately, the same vertical level, and the inlets 30 and outlets 36 are normally located well below the surface level of the liquid refrigerant within the receiver 26 during normal operation of the refrigeration circuit as represented at line 40 in FIG. 3.

As will be appreciated from the above description, the heat exchanger 10 will be connected in the refrigeration circuit such that gaseous refrigerant to be condensed will be supplied to the heat exchanger through inlet tube 22, and liquified refrigerant to be expanded will exit the heat exchanger 10 through the outlet tube 38. The pressurized gaseous refrigerant entering the coils 12 through the manifold inlets 24 will be cooled by the air passing through the fins 16, and this cooling will liquify the refrigerant which will pass through outlets 28 into the receiver 26 and accumulate in the lower regions of the receiver.

The pressure within the receiver 26 will force the liquified refrigerant through the coils 14 through the inlets 30, and the liquified refrigerant will further be cooled, i.e. subcooled, as it passes through coils 14. The subcooled liquified refrigerant from coils 14 is supplied to the manifold 32 and exits the heat exchanger assembly through the outlet tube 38 to the expansion device.

In accord with the invention, the receiver 26 is of a relatively large volume as compared to the volume within the coils 12 and 14. Preferably, the volume of the receiver 26 is at least 15% greater than the volume within the coils 12 and 14, and in actual practice, the volume of the receiver 26 is designed to constitute a sufficient storage or receptacle for the liquified refrigerant as to supply the circuit with the refrigerant in liquid form required by the capacity of the refrigeration circuit. Accordingly, the receiver 26 simultaneously performs the function of a header for the heat exchanger 10, and as a receiver reservoir for the liquified refrigerant.

As the liquified refrigerant within receiver 26 will accumulate in the lower region of the receiver due to the vertical orientation of the receiver 26, the subcooling coils 14 will be automatically supplied with a liquified refrigerant and all of the refrigerant will be subcooled to prevent "flash back". By forming the receiver 26 to simultaneously function as the heat exchanger header and as a receptacle for the liquified refrigerant, the manufacturing techniques of the necessary components of a refrigeration system are simplified, cost is reduced, and the space required for the subcooling and liquified refrigerant storage are reduced as compared to conventional arrangements.

In this description, and claims, the heat exchanger 10 is described as being vertically oriented, and it is to be understood that such vertical orientation includes mounting the heat exchanger coils and the receiver 26 in a slanted or oblique relationship to the vertical. In a number of installations, it is advantageous, for space saving purposes, to mount the heat exchanger and associated receiver and manifolds obliquely to the vertical, for instance as much as 45°, and it will be appreciated that in such a slanted orientation the liquid refrigerant will collect in the lower region of the receiver 26, and the inventive concepts will be practiced.

It is appreciated that various modifications to the inventive concepts may be apparent to those skilled in the art without departing from the spirit and scope of the invention.

I claim:

1. A refrigeration circuit heat exchanger for condensing a refrigerant comprising, in combination, a condenser unit having a first set of cooling coils and a second set of cooling coils, said first set of cooling coils having first inlets and first outlets, said second set of cooling coils having second inlets and second outlets, an elongated vertically oriented receiver located adjacent said condenser having an upper region and a lower region, a first elongated inlet manifold mounted on said receiver upper region along the length of said receiver having a gaseous refrigerant inlet, said first inlets being in communication with said first manifold, said first outlets communicating with said receiver upper region, said second inlets communicating with said receiver lower region, a second elongated manifold having a liquid refrigerant outlet mounted upon said receiver lower region along the length of said receiver, said second outlets communicating with said second manifold, the volume within said receiver being at least 15% greater than the volume within said first and second sets of coils.

2. In a refrigeration circuit heat exchanger as in claim 1, said second inlets and outlets being located at approximately the same vertical level.

3. In a refrigeration circuit heat exchanger as in claim 1, said second inlets communicating with said receiver lower region below the surface level of liquid refrigerant within said receiver during normal refrigerant circuit operation.

* * * * *